United States Patent [19]

Kerr

[11] Patent Number: 4,571,897

[45] Date of Patent: Feb. 25, 1986

[54] APPARATUS FOR MOUNTING SHEET MATERIAL AND MOUNTING ASSEMBLY AND STRUCTURAL SURFACE FORMED THEREWITH

[76] Inventor: Fred Kerr, P.O. Box 764, Huntersville, N.C. 28078

[21] Appl. No.: 515,808

[22] Filed: Jul. 21, 1983

[51] Int. Cl.[4] ..... E04B 1/00

[52] U.S. Cl. ..... 52/13; 52/222; 52/200

[58] Field of Search ..... 52/222, 200, 473, 13, 52/63; 47/17

[56] References Cited

U.S. PATENT DOCUMENTS

| | | | |
|---|---|---|---|
| 2,842,811 | 7/1958 | Weeks | 52/473 |
| 2,986,150 | 5/1961 | Torian | 47/17 |
| 3,325,951 | 6/1967 | Johnson | 52/200 |
| 3,470,662 | 10/1969 | Kellman | 52/573 |
| 3,763,606 | 10/1973 | Rindebong | 52/222 |
| 3,982,361 | 9/1976 | Deutsch | 52/222 |
| 4,428,169 | 1/1984 | Tsakiris | 52/200 |

FOREIGN PATENT DOCUMENTS

| | | | |
|---|---|---|---|
| 968114 | 5/1975 | Canada | 52/200 |
| 1398876 | 5/1965 | France | 52/222 |
| 506939 | 6/1939 | United Kingdom | 52/200 |

*Primary Examiner*—Henry E. Raduazo

*Attorney, Agent, or Firm*—Shefte, Pinckney & Sawyer

[57] ABSTRACT

Apparatus for mounting continuous length sheets of thermo-expansive transparent plastic includes longitudinal rods for affixation along the longitudinal edges of each sheet to form a thickness enlargement thereat and mounting members having channels formed therein adapted to receive and retain the enlargement. The channel has an interior area larger than the rods and a restricted outward opening smaller than the rods but larger than the sheet thickness whereby in assembly space exists in the receiving area unoccupied by the rods and in the restricted opening unoccupied by the sheet permitting shifting movement of the enlargement and the sheet therewithin for relatively free thermo-expansion of the sheet. Each sheet is supported in flexed condition along its lengthwise edges by two such mounting members. Plural sheets may be mounted in side-by-side arrangement to form a roof or other structural or architectural surface. Sheets may be mounted by this system to form overhead skylights, canopies or the like.

33 Claims, 10 Drawing Figures

Fig. 8
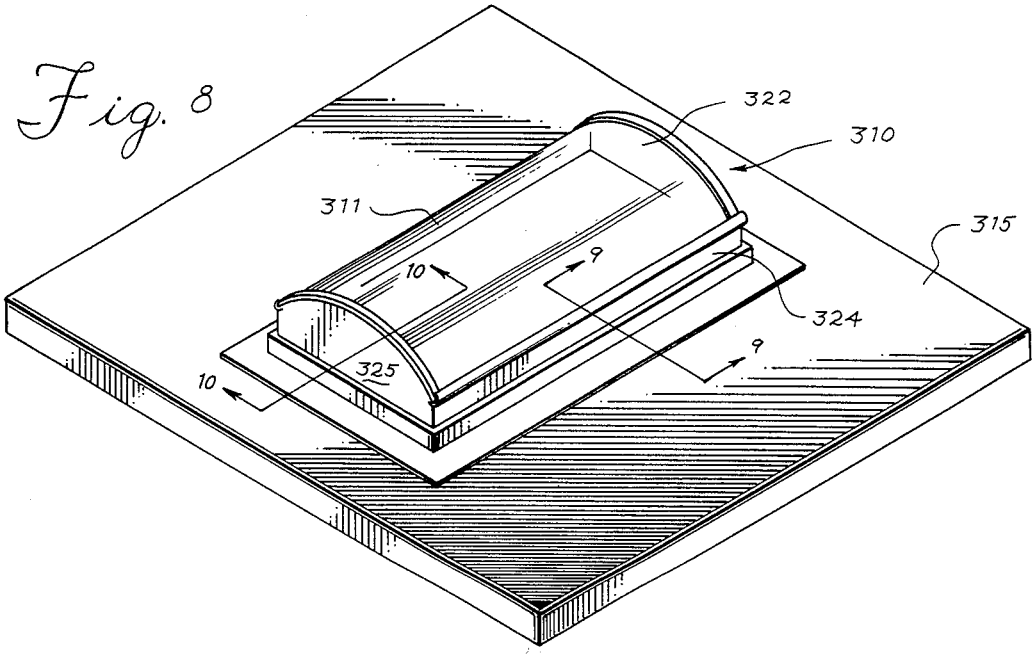
Fig. 10
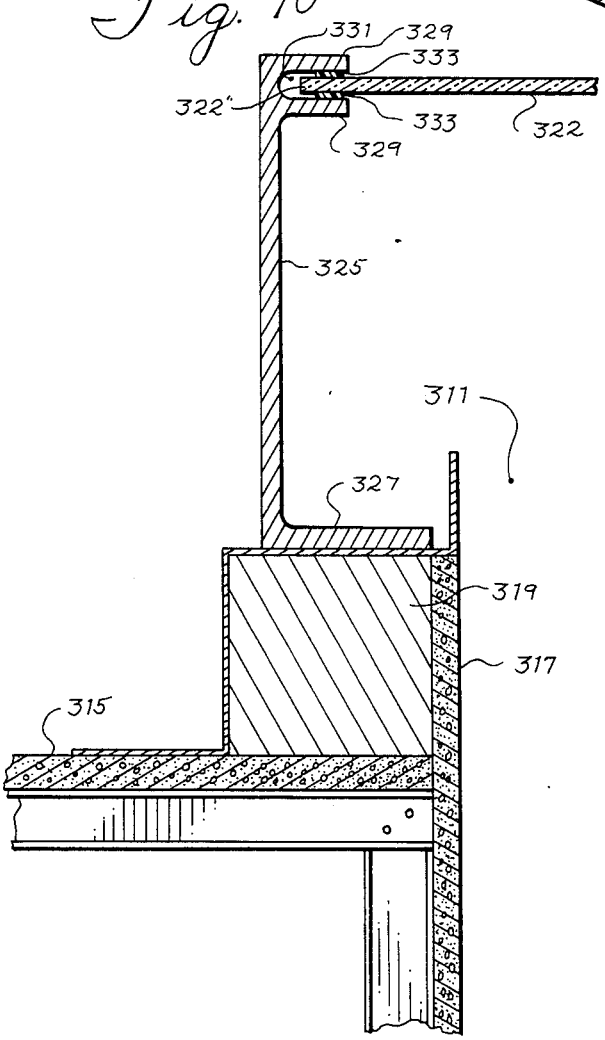
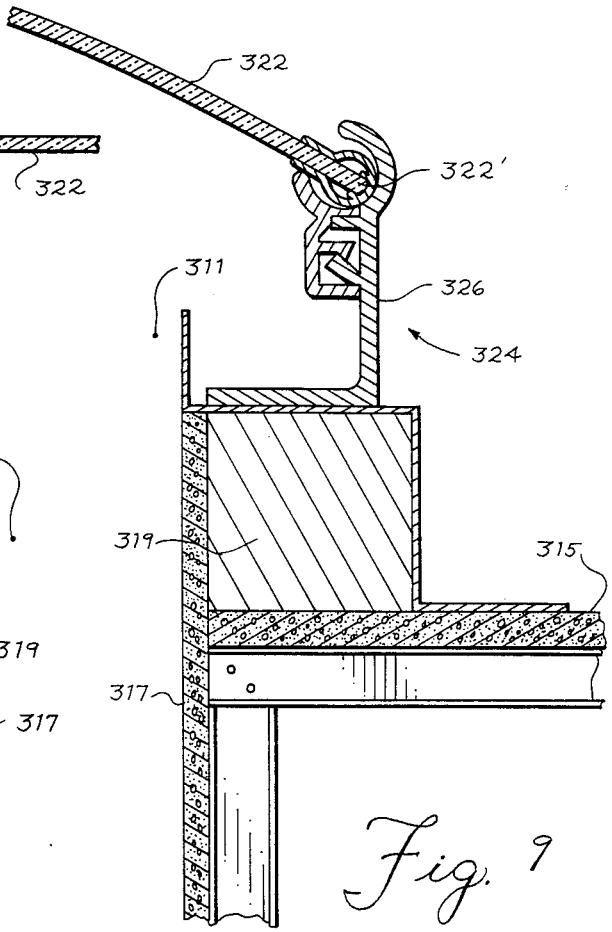
Fig. 9

APPARATUS FOR MOUNTING SHEET MATERIAL AND MOUNTING ASSEMBLY AND STRUCTURAL SURFACE FORMED THEREWITH

BACKGROUND OF THE INVENTION

The present invention relates to mounting systems for sheet material, particularly thermo-expansive and contractive architectural sheet material such as polycarbonate and acrylic sheeting, and to such systems by which such sheet material is employed in building and like structures as a structural surface thereof, a skylight assembly, or the like.

Various forms of polycarbonate, acrylic and like plastic sheet material, ordinarily of a transparent or translucent form, have come into widespread use in recent years as a relatively low-cost substitute for glass. Examples of such sheeting include LEXAN brand polycarbonate plastic sheeting manufactured by General-Electric Company, Sheet Products Section, Pittsfield, Mass., similar polycarbonate sheeting manufactured by Sheffield Plastics Corp., Sheffied, Mass., and PLEXIGLAS brand methyl acrylate plastic sheeting manufactured by Rohm & Haas Company, Philadelphia, Pa. Such types of plastic sheeting are readily susceptible of virtually any use to which sheet glass is conventionally put, particularly in architectural and structural uses in the construction of buildings and like structures. Furthermore, because such types of plastic sheeting are more flexible and resilient than glass, such sheeting may be employed in curved or molded forms in which glass is either unavailable or prohibitively expensive. By way of example, such plastic sheeting is now conventionally used in windows, storm doors, skylights, greenhouses, shelters such as bus stops, and many other like embodiments.

In the conventional manner by which ordinary glass is mounted, such plastic sheeting is mounted in place by use of a supporting framework, typically aluminum framing members, which encloses and seals the edges of each individual sheet. It is known in the art that ordinary glass and conventional framing materials such as aluminum have generally comparable thermo-expansional and contractional properties and therefore no particular engineering or design problems are presented in constructing supporting framework for ordinary glass. However, in contrast, it is also known in the art that plastic sheeting of the type presently concerned is substantially more expansively and contractively sensitive to temperature changes than are ordinary glass and conventional framing materials. Accordingly, particular provisions must be made in the construction and design of supporting framework for such plastic sheeting in order to accommodate dimensional changes therein likely to occur due to expected ordinary temperature changes in the intended environment of the sheeting. Under conventional practice, conventional glass mounting framework is employed for such plastic sheeting with open spacings being provided in the supporting framework for expansion thereinto of the sheeting material. In the past, substantial problems have been encountered in mounting such plastic sheets in an acceptable manner meeting the two-fold requirements of adequately providing for expansion and contraction of the sheets while also obtaining watertight seals at the mounted edges of the sheets. To alleviate water leakage problems in mounting systems of such plastic sheeting, it has become conventional practice and wisdom that such plastic sheeting must be employed in relatively small sheets to achieve a reduced absolute amount of potential expansion and contraction per sheet and thereby presumably reduce expansionally and contractionally-related leakage problems. However, because such an approach generally requires a greater number of sheets in any particular mounting system and therefore requires a greater number of sealed sheet edges, the number of possible leakage points is significantly increased by this approach and, in practice, leakage problems persist in systems employing this approach.

At least certain brands of the plastic sheeting presently concerned, specifically LEXAN and SHEFFIELD polycarbonate sheeting, are manufactured and available in continuous lengths of up to several hundred feet or more having uniform widths of between approximately four and eight feet and marketed either in flat sheet form of relatively short lengths or in considerably greater lengths rolled for convenience onto a suitable spool. The availability of such continuous length plastic sheeting is not widely known and, in any event, is not considered to provide any particular advantages in the uses of the sheeting because of the above-discussed conventionally-recognized and understood limitations in the usable sizes of such sheeting. In fact, such continuous length sheeting is substantially only purchased by wholesale suppliers of sheeting who cut the continuous length sheeting into individual sheets of uniform conventional sizes for resale.

In contrast, the present invention provides a novel apparatus by which a continuous length of plastic or similar sheeting of virtually any length and width may be mounted so as to permit relatively free thermal expansion and contraction of the sheet while also preventing the leakage of water at the mounted edges thereof. As will be appreciated, the possible uses of the mounting apparatus are virtually limitless.

SUMMARY OF THE INVENTION

Briefly and basically described, the present invention provides an apparatus for mounting an edge of a sheet of thermo-expansive and contractive material to a supporting surface and basically includes an arrangement adapted for affixation at the sheet edge for forming a thickness enlargement thereat and a mounting arrangement adapted for affixation to the supporting surface and having a channel arrangement for receiving and retaining therein the enlargement. The channel arrangement defines an enlarged interior receiving area profiled compatibly with and larger than the enlargement and a restricted outward opening smaller than the enlargement but larger than the enlarged thickness of the sheet. In this manner, space is left in the receiving area unoccupied by the enlargement and in the restricted opening unoccupied by the adjacent sheet portion thereby permitting shifting movement of the enlargement and the sheet portion respectively within the receiving area and the restricted opening for relatively free thermal expansion and contraction of the sheet.

In the preferred embodiment, the sheet is of a transparent plastic polycarbonate material the sheet edge of which is substantially linear and the enlargement-forming arrangement is a plurality of longitudinal cylindrical rod elements each having a substantially axial channel therein for spaced affixation along the edge receiving it in their respective channels. The mounting arrangement is preferably of the form of a mounting member and its channel arrangement is of a longitudinal extent of substantially the same length as the sheet edge and its receiving area is of substantially circular transverse cross-section. In this manner, the substantially smoothly rounded surface of the receiving area acts as a cam surface for the compatibly rounded enlargement during its shifting movement for relatively free sliding movement of the enlargement thereabout. The restricted opening is generally rounded for non-abrasive contact with the adjacent sheet portion during such shifting movement.

Water-impervious flexible sealing members may be provided to be affixed to the channel arrangement on each side of the restricted opening respectively to extend therefrom into sealing contact with the respectively adjacent side of the sheet. The mounting member is preferably constructed for affixation to the supporting surface with the channel arrangement extending generally horizontally and with the restricted opening facing generally upwardly for drainage of water into the channel arrangement. A weep hole is provided in the channel arrangement extending therethrough outwardly from the receiving area for drainage of water entering the channel.

In one embodiment, the channel arrangement is open at at least one of its ends for slidable insertion of the enlargement into the receiving area and of the adjacent unenlarged portion of the sheet into the restricted opening. In another embodiment, the channel arrangement includes selectively assemblable and disassemblable mating channel members adapted in disassembly for receiving the enlargement and the adjacent sheet portion and adapted in assembly for defining the restricted opening and the receiving area for retaining the enlargement.

The apparatus of the present invention may be embodied in a mounting assembly in a building structure or the like wherein an enlargement forming arrangement is provided along two opposed edges of the sheet and two of the mounting members are affixed to respective supporting surfaces of the building structure with their channel arrangements in spaced, facing relation and receive and retain the enlargements respectively. The channel arrangements may be spaced apart a distance less than the dimension of the sheet between its opposed edges for mounting of the sheet in a flexed condition such that expansion and contraction thereby respectively effect greater and lesser sheet flexure. Preferably, the restricted openings face in the direction of flexure of the sheet. In this embodiment, the assembly preferably forms a skylight, canopy or the like.

The present apparatus may also be embodied in a structural surface in a building structure or the like wherein a plurality of continuous sheets are arranged in generally side-by-side relation forming a generally continuous transparent surface, and, for each such sheet, an enlargement forming arrangement is provided along two opposed edges thereof and two mounting arrangements are affixed to the building structure and receive and retain the enlargements, respectively. Preferably, the two opposed edges of each sheet are parallel, longitudinal side edges thereof and the plurality of sheets are arranged with all such side edges generally parallel with one another. Each such sheet may be mounted in the above-described flexed condition. In one form, all of the sheets are flexed outwardly of the surface while, in another form, alternating sheets are flexed outwardly and intermediate sheets are flexed inwardly of the surface. In either form, all of the sheets may be mounted to extend horizontally. In the first-mentioned form, a gutter may be provided extending between and below each adjacently disposed non-associated pair of mounting members for substantially the full length thereof. In the second-mentioned form, the alternating sheets are flexed upwardly and the intermediate sheets are flexed downwardly and the sheets are arranged such that a downwardly-flexed sheet extends between and below each adjacently-disposed pair of upwardly-flexed sheets.

BRIEF DESCRIPTION OF THE DRAWINGS

FIG. 8 is a perspective view of a building skylight assembly according to the preferred embodiment of the present invention;

FIG. 9 is a partial vertical sectional view of the skylight assembly of FIG. 8 taken along line 9—9 thereof; and FIG. 10 is another partial vertical sectional view of the skylight assembly of FIG. 8 taken along line 10—10 thereof.

DESCRIPTION OF THE PREFERRED EMBODIMENT

Figure 1:
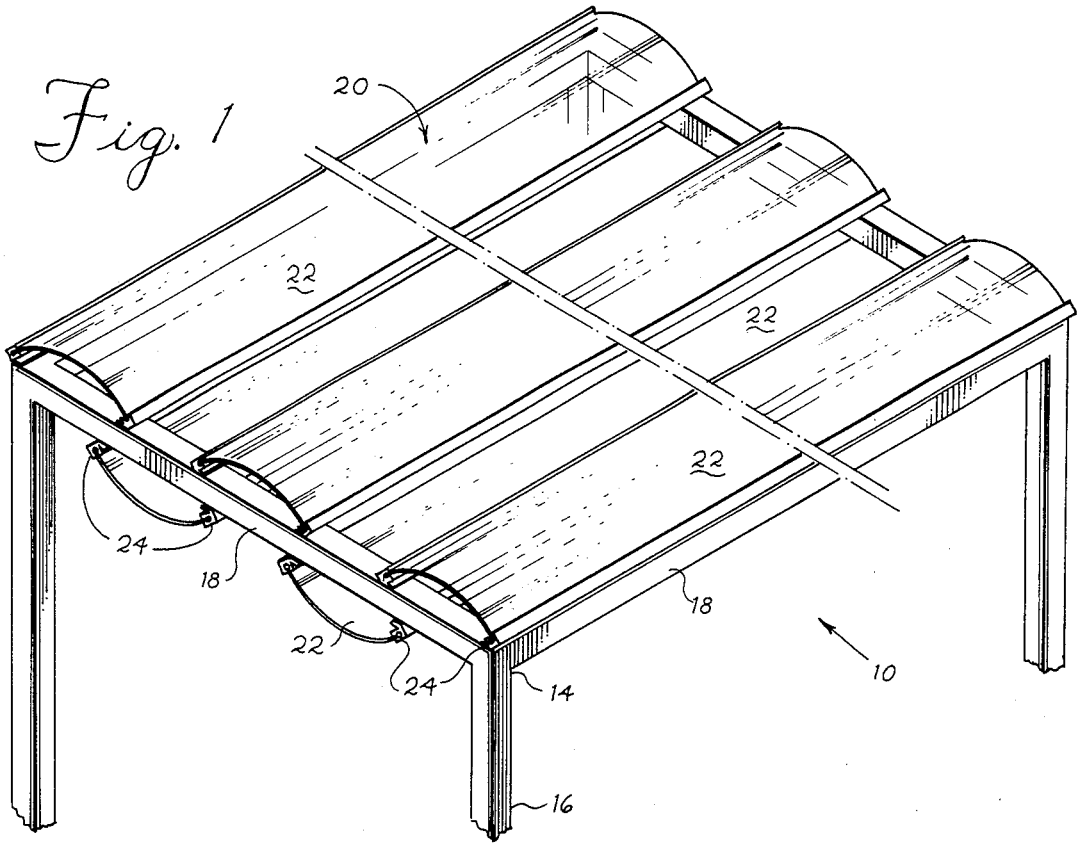
FIG. 1 is a perspective view of a rain shelter having an overhead structural surface formed according to one preferred embodiment of the apparatus of the present invention.
Figure 2:
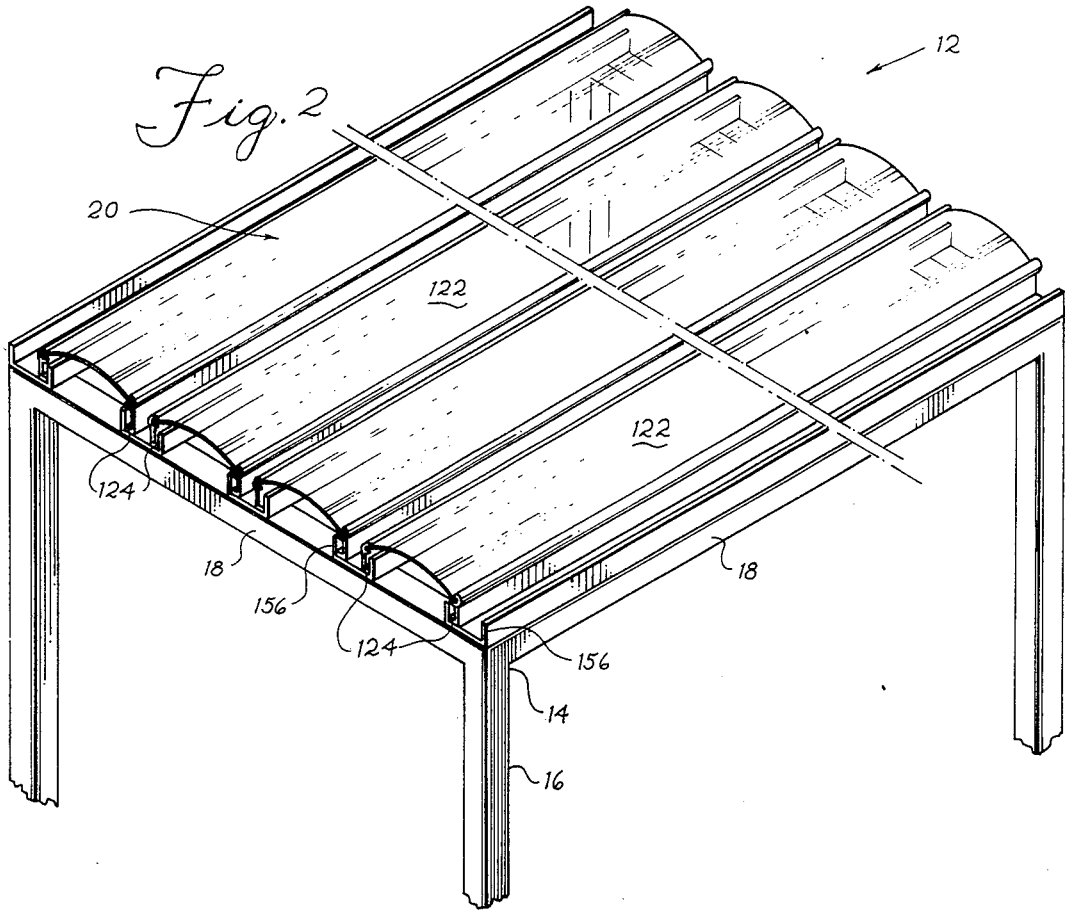
FIG. 2 is a perspective view of another rain shelter having an alternative form of overhead structural surface according to another preferred embodiment of the apparatus of the present invention.

Referring now to the accompanying drawings, two different forms of rain shelters, indicated generally at 10 and 12, respectively, are shown in FIGS. 1 and 2, respectively. Each rainshelter 10,12 has a structural framework 14 which includes vertical supporting columns 16 and a network of horizontal beams 18 supported on and affixed to the upward ends of the columns 16. The structural framework 14 may be of substantially any conventional construction, e.g. of preformed concrete members or of steel "I" beams or the like, erected in conventional manner on a concrete slab, foundation or other suitable erection surface and accordingly the framework 14 has been shown only schematically and will be understood to be merely representative and exemplary. A structural roof surface, indicated generally at 20, is supported across the network of horizontal beams 18 in each rain shelter 10,12. Each structural roof surface 20 includes a plurality of transparent sheets 22 of substantially identical elongate rectangular shape extending lengthwise across the network of horizontal beams 18 in side-by-side parallel arrangement. The transparent sheets 22 are unitary continuous length sheets formed of plastic polycarbonate sheeting manufactured and sold by Sheffield Plastics Corp., Sheffield, Mass. Each lengthwise side edge 22' of each sheet is affixed in place on the network of horizontal beams by a respective mounting arrangement 24, to be presently described.

Figure 3:
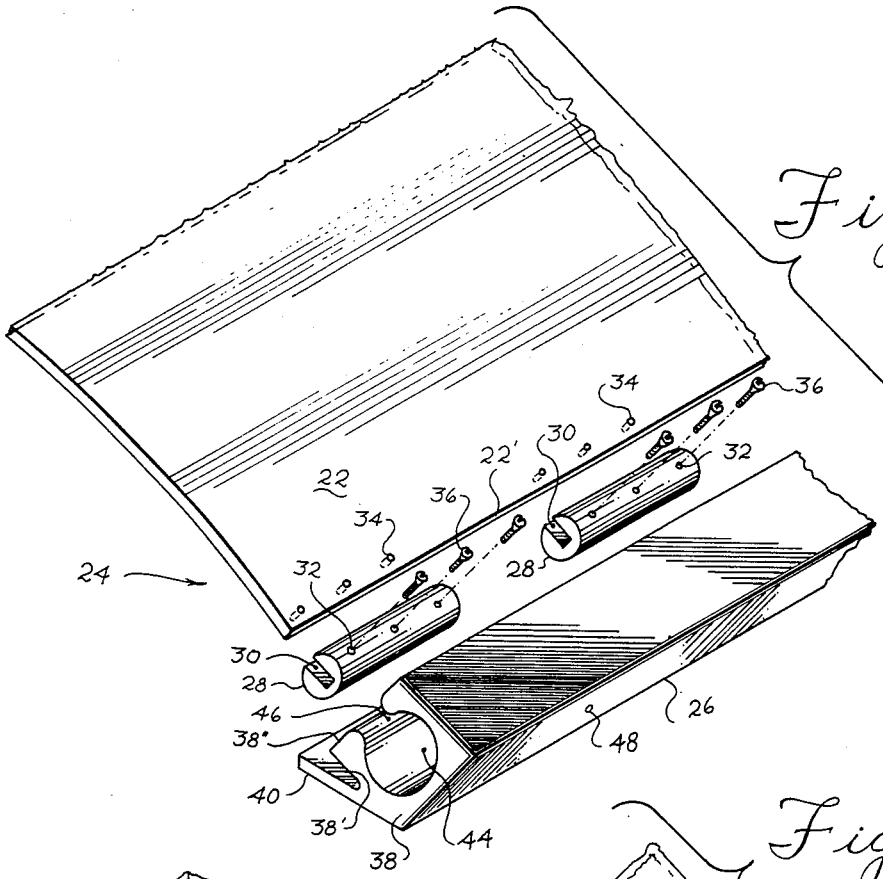
FIG. 3 is an exploded perspective view of one mounting arrangement of a mounting member, an enlargement-forming rod and an edge of one sheet, all partially broken away, as employed in the rain shelter of FIG. 1.

One mounting arrangement 24 is shown in exploded form in FIG. 3 and basically includes an elongate mounting member 26 and a plurality of cylindrical rods 28. The cylindrical rods 28 are preferably formed of aluminum or another relatively inexpensive, non-corrosive metal or comparable material. Each rod 28 is of a relatively short length, preferably approximately four to six inches, and has an axial channel or groove 30 formed radially therein along its entire length and has several spaced threaded bores 32 radially tapped and countersunk therein perpendicularly to and opening into the axial groove 30. The axial groove 30 is formed to approximately the same width as the thickness of a sheet 22. The mounting arrangement 24 also includes a plurality of threaded countersunk screws 36 mated with the bores 32 of the rods 28. Each lengthwise side edge 22' of each sheet 22 has a plurality of bores 34 formed therethrough at spacings along the edge 22' corresponding to the spacings between the bores 32 in the rods 28. Thus, each rod 28 is adapted to receive a side edge 22' of a sheet 22 in the rod's axial groove 30 and each rod 28 may then be affixed to the side edge 22' by alignment of the rod's bores 32 with bores 34 of the side edge 22' and driving and tightening of screws 36 into the rod's bores 32. In this manner, the plurality of rods 28 of each mounting arrangement 24 are affixed to an associated side edge 22' of a sheet 22 at spacings along the entire length thereof, the rods 28 preferably being centered every eight to twelve inches along the length of the sheet edges 22, whereby the rods 28 form a beaded thickness enlargement in the sheet 22 at the edges 22'.

The mounting member 26 is formed as an elongate unitary extrusion of aluminum or another non-corrosive metal or material of substantially the same length as the longitudinal side edges 22' of the sheets 22. The mounting member 26 includes a main body 38 of substantially square transverse cross-section and has an integral mounting flange 40 extending angularly from the lengthwise corner edge of one side surface 38' of the main body 38. The mounting flange 40 has plural openings 45 formed therein at predetermined spacings along the length of the flange 40 for receiving bolts or other fasteners by which the mounting member 26 may be affixed to a supporting surface. A channel 42 is formed in the main body 38 along its entire length and opens outwardly at the side surface 38'' thereof adjacent other corner edge of the side surface 38' and also opens outwardly at the ends of the main body 38. The channel 42 includes a central area 44 formed as a cylindrical bore longitudinally centrally through the entire length of the main body 38 and occupying a substantial portion of the entire transverse cross-sectional area of the main body 38. The channel 42 also includes an outward opening area 46 generally formed as a longitudinal groove of a substantially smaller transverse dimension than the central area 44 extending from the central area 44 outwardly to the side surface 38'' for the entire length of the main body 38, the groove forming the outward opening channel 46 being rounded to provide a smooth transition from the central area 44. The central area 44 is substantially larger in transverse cross-sectional area than the transverse cross-sectional area of a rod 28. The outward opening area 46 is of a transverse cross-sectional dimension taken parallel to the surface 38'' smaller than the diametric dimension of a rod 28 but larger than the diametric dimension of a sheet 22. Thus, a side edge 22' of a sheet 22 to which a plurality of the rods 28 have been affixed as above-described may be slidably inserted into the channel 42 of an associated mounting member 26 at an end thereof by positioning one end of the sheet 22 for insertion of the edge 22' and the rods 28 affixed thereto into the enlarged central channel area 44 and for insertion of the adjacent unenlarged portion of the sheet 22 into the outward opening channel area 46 and by sliding the sheet 22 lengthwise relative to the channel 42 until the entire length of the side edge 22' is contained within the channel 42. As may be desirable in particular applications more fully discussed hereinafter, the main body 38 may have weep holes 48 extending therethrough from the enlarged central channel area 44 to the side surface 38''' opposite the side surface 38'' to which the channel 42 opens to permit drainage of moisture accumulating in the channel 42.

Figure 5:
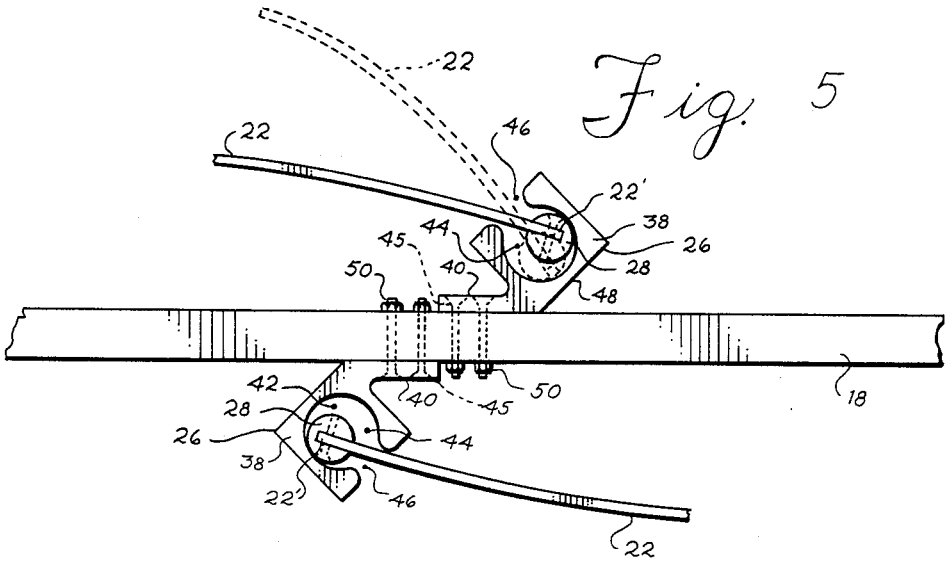
FIG. 5 is a partial end elevation view of the rain shelter of FIG. 1.

The particular construction of the rain shelter 10 employing mounting arrangements 24 may best be understood with reference to FIGS. 1 and 5. The beams 18 schematically represent a supporting roof sub-structure, the beams 18 being welded or bolted together in conventional fashion in a rectangular configuration which may be of substantially any ordinary length and/or width, e.g. 50 feet by 75 feet. As necessary according to the particular construction and dimensions of the desired rain shelter 10, intermediate horizontal cross beams (not shown) may be affixed to the outer lengthwise and widthwise beams 18 to extend intermediately therebetween for additional support and additional vertical supporting columns (not shown) like columns 16 may also be provided at selected locations other than the corners of the supporting roof sub-structure of beams 18 as necessary for proper support thereof, all in conventional manner according to conventional architectural parameters. According to the construction of the rain shelter 10, a plurality of the transparent sheets 22 of uniform lengths at least the same as the lengthwise dimension of the supporting roof sub-structure of horizontal beams 18 and of uniform widths of four to eight feet are employed. A pair of the mounting members 26 are provided for each sheet 22, the mounting members 26 each being of a lengthwise dimension generally the same as the lengthwise dimension of the supporting roof sub-structure of beams 18. The pairs of mounting members 26 are mounted by bolt and nut arrangements 50 alternately to the upper and lower surfaces of the beams 18 to extend lengthwise of the supporting roof sub-structure, the respective mounting members 26 of each such pair being thusly arranged in spaced parallel relation a predetermined distance less than the widthwise dimension of the sheets 22 and with their respective channels 42 in opposed facing relationship, with the alternating pairs of upper and lower-mounted mounting members 26 being respectively arranged in staggered fashion such that each lower-mounted mounting member 26 extends intermediately of an associated pair of upper-mounted mounting members 26, for purposes to be hereinafter more fully described. In this manner, each associated pair of upper-mounted mounting members 26 have their respective channels 42 opening generally angularly upwardly in facing relation to each other and each associated pair of lower-mounted mounting members 26 have their respective channels 42 opening generally angularly downwardly in facing relation to one another. A plurality of the rods 28 are affixed to the opposite longitudinal side edges 22' of each sheet 22 by screws 36 in the aforedescribed manner at regular spacings along the length of each sheet 22. The longitudinal side edges 22' of each sheet 22 and the rods 28 affixed thereto are slidably inserted into the respective channels 42 of the respectively-associated pair of mounting members 26 from the open ends of the channels 42 at one end of the supporting roof sub-structure also as previously described, the sheet 22 of necessity being slightly bowed arcuately in this process due to the spacing of the respective mounting members 26 of each pair at a distance smaller than the widthwise dimension of each sheet 22.

In this manner, each sheet 22 mounted by a pair of mounting members 26 affixed to the upper side of the beams 18 is flexed upwardly and outwardly from the supporting framework 14 while each sheet 22 mounted by a pair of mounting members 26 affixed to the lower surface of the beams 18 is flexed downwardly and inwardly of the framework 14. Due to the aforedescribed staggered arrangement of the pairs of mounting members 26, each downwardly flexed sheet 22 mounted by a lower-mounted pair of mounting members 26 in effect forms a gutter beneath and between the adjacent upwardly-flexed sheets 22 mounted by upper-mounted mounting members 26. The roof surface 20 thusly formed collectively by the plural sheets 22 will be understood to essentially shelter the confined area within the structural framework 14 from rain and other atmospheric precipitation. Specifically, the upward flexure of the sheets 22 mounted by the upper-mounted pairs of mounting members 26 causes rain and other precipitation to be shed to the longitudinal sides of the sheets 22 and therefrom either into the channels 42 of the associated mounting members 26 or over the associated mounting members 26 onto the upwardly facing surfaces of the adjacent downwardly flexed sheets 22 whereat such precipitation collects with any other precipitation directly falling on the downwardly flexed sheets 22. Desirably, the supporting roof sub-structure of beams 18 is provided with a slight downward incline or pitch from one longitudinal end thereof to the other whereby precipitation entering the channel 42 of any mounting member 26 will drain to the open end thereof at the lower-inclined end of the substructure and precipitation collecting on the upwardly-facing surface of the downwardly-flexed sheets 22 will similarly drain to the end of the sheets 22 at such end of the substructure. Due to the described drainage, the mounting members 26 in the rain shelter 10 need not be provided with weep holes 48 in their main bodies 38, but it may nevertheless be desirable to employ such weep holes 48 in order to enhance the drainage of precipitation from within the channels 42 of the mounting members 26 affixed to the upper side of the beams 18.

Figure 4:
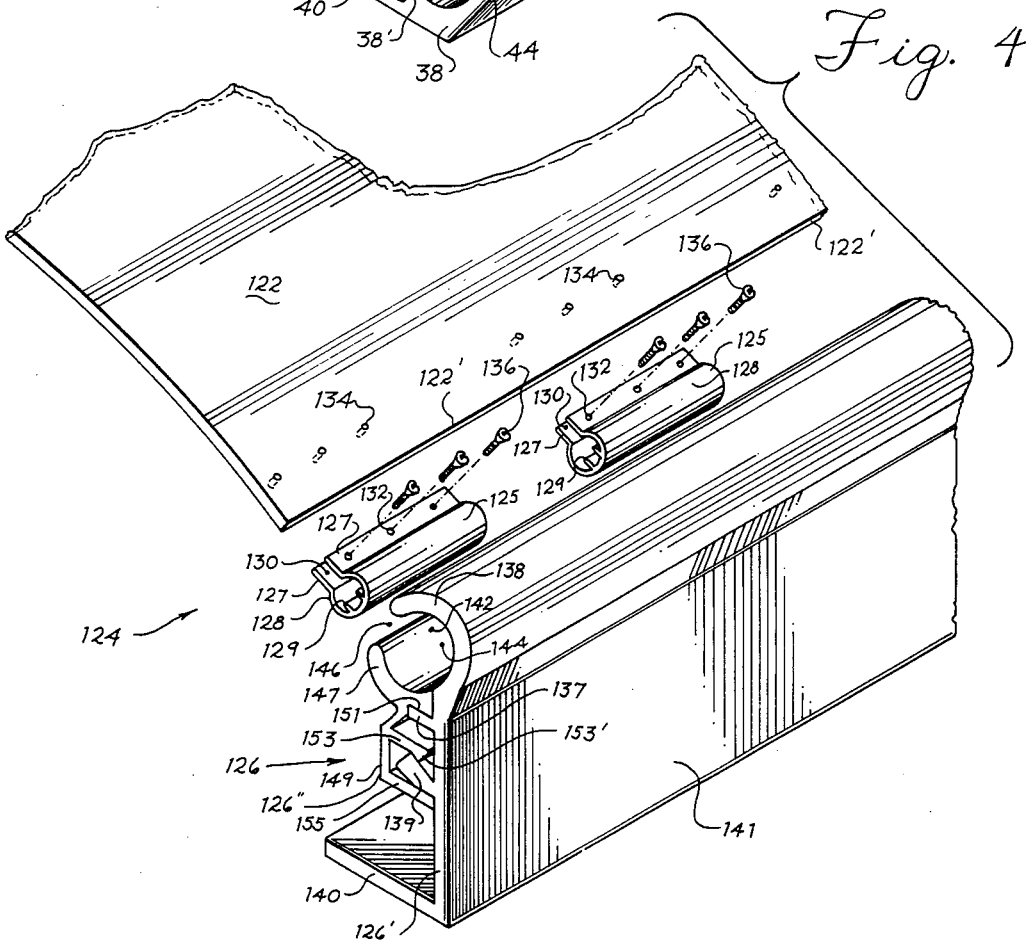
FIG. 4 is an exploded perspective view similar to FIG. 3 of another embodiment of one mounting arrangement of a mounting assembly, an enlargement-forming rod and an edge of one sheet, all partially broken away, as employed in the rain shelter of FIG. 2.

Another embodiment of the mounting arrangement of the present invention is shown in exploded form in FIG. 4 generally at 124 and basically includes a modified form of elongate mounting assembly 126 and a plurality of modified rods 128. As with the rods 28, the rods 128 are preferably formed of aluminum or another non-corrosive or comparable material. Each rod 28 has a tubular cylindrical portion 125 having an axially-extending opening 127 therealong from opposite sides of which legs 129 extend outwardly in substantially parallel relation spaced approximately the same dimension as the thickness of one sheet 22. Two axially-extending spaced ribs 129 are formed along the inner surface of the rod 128 opposite the legs 127, the legs 127 and the ribs 129 cooperatively defining a radial channel 130 extending the axial length of the rod 128. Each rod 128 has several spaced bores 132 tapped and countersunk in respective alignment through its legs 129 and each side edge 122' of each sheet 122 has a plurality of bores 134 formed therethrough at corresponding spacings along the edge 22'. Thus, each rod 128 is adapted to receive a side edge 122' of a sheet 22 in the channel 130 and each rod 128 may then be affixed to the side edge 122' by alignment of the respective bores 132,134 of the side edge 122' and the rod 128 through which threaded screws 136 are extended and tightened. In this manner, the plurality of rods 128 of each mounting arrangement 124 are affixed to an associated side edge 122' of a sheet 122 at spacings along the entire length thereof and the rods 128 thereby form a beaded thickness enlargement in the sheet 122 at the edges 122'.

The mounting assembly 26 includes two mating mounting members 126',126'' both of which are formed as elongate unitary aluminum extrusions of substantially the same length as the longitudinal side edges 122' of the sheets 122. The mounting member 126' includes a mounting flange 140 from one longitudinal side of which extends perpendicularly a supporting wall 141. An arcuate channel portion 138 is formed at the extending edge of the wall 141 facing generally in the same direction as the mounting flange 140 extends. Two flange members 137,139 extend from the wall 141 adjacent its extending end also generally in the same direction as the mounting flange 140, the flange member 137 extending from immediately adjacent the extending edge of the wall 141 in parallel relation to the mounting flange 140 and the flange member 139 extending from the wall 141 intermediate the flange member 137 and the mounting flange 140 angularly outwardly of the mounting flange 140. The mounting member 126' includes an arcuate channel portion 147 from the outward side of which extends an attachment portion 149. The outward side of the arcuate portion 147 to one side of the attachment portion 149 is formed with a flat surface 151 and the attachment portion 149 includes two legs 153,155 which extend in the same direction as the flat surface 151 in substantially parallel relation therewith at respective spacings therefrom and from each other. The flat surface 151 and the legs 153,155 facilitate the mated joinder of the two mounting members 126',126'' by a snap fit, the flat surface 151 of the member 126'' being adapted to rest on the flange member 137 of the member 126' with the respective arcuate portions 138,147 of the two members 126',126'' arranged coaxially and coextensively and the two legs 153,155 of the member 126'' being adapted to grippingly engage the flange member 139 of the member 126' on opposite sides thereof, the leg 153 having a depending lip 153' adapted to resiliently snap about the outward angularly extending side of the flange member 139 with the leg 155 engaging the other side of the flange member 139. In the assembled condition of the mounting members 126',126'', the respective arcuate portions 138,147 thereof cooperatively define a channel 142 of substantially the same shape and dimensioning as the channel 42 of the mounting member 26, the channel 142 including a central area 144 substantially larger in transverse cross-sectional area than the transverse cross-sectional area of the rod 128 and including a restricted outward opening area 146 of a transverse dimension smaller than the transverse cross-sectional area of the rod 128 but larger than the thickness of a sheet 122. As may be desirable, weep holes 148 may be provided through the arcuate portion 138 of the mounting member 126'.

Figure 6:
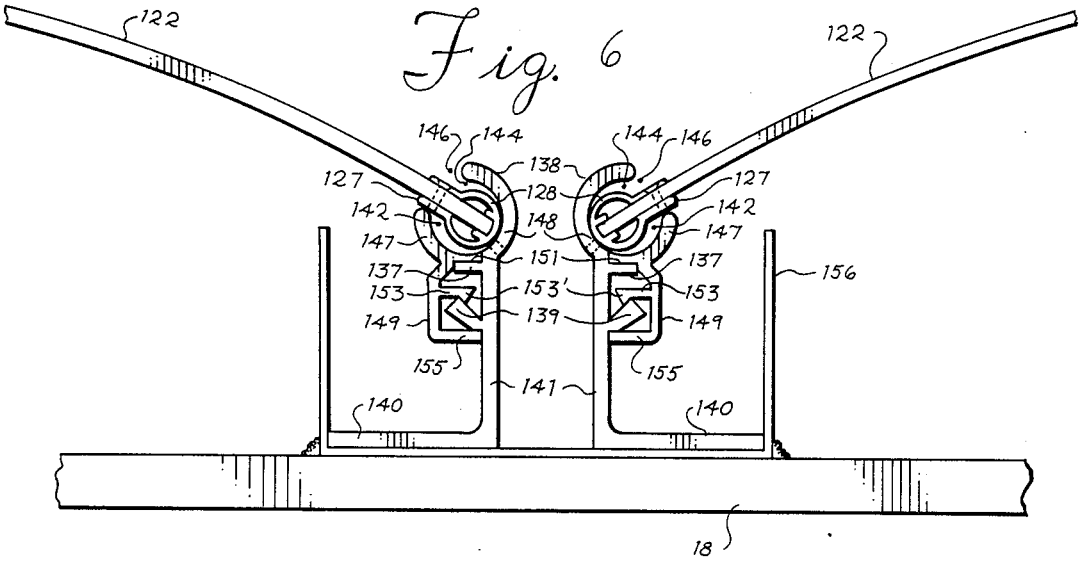
FIG. 6 is a partial end elevational view of the rain shelter of FIG. 2.

The particular construction of the rain shelter 12 may best be seen and understood with reference to FIGS. 2 and 6, wherein a supporting framework 14 identical to that shown in and hereinabove described regarding FIGS. 1 and 5. According to this embodiment of the present invention, a plurality of elongate gutters 156 of the same length as the lengthwise dimension of the supporting roof substructure of beams 18 are welded or otherwise affixed to the upper surfaces of the beams 18 to extend lengthwise therewith in parallel relation at selected spacings less than the widthwise dimension of the sheets 22. A single mounting member 126' is affixed by its mounting flange 140 by welding, bolting or in another conventional manner to the upwardly facing interior surface of each of the two gutters 156 extending along the longitudinal sides of the supporting roof substructure, with the respective channel portions 138 of such mounting members 126' facing inwardly of the framework 14. In each other gutter 156, a pair of mounting members 126' are similarly affixed to the gutter 156 side by side with their respective arcuate channel portions 138 facing away from one another. In this manner, the mounting members 126' are arranged in associated pairs with their arcuate channel portions 138 in opposed facing relation such that each pair of mounting members 126' is adapted to support one sheet 122. Preferably, the mounting members 126'' are not initially attached to the mounting members 126'. With the mounting members 126'' disassembled from the mounting members 126', a sheet 122 having the rods 128 affixed along its longitudinal edges 122' is flexed and positioned relative to an associated pair of mounting members 126' to bring the rods 128 at each side edge 122' of the sheet 122 into engagement with the respective arcuate channel portions 138 of the mounting members 126'. After such positioning of each sheet 122, the sheet 122 will be retained in such disposition under the biasing force of the sheet 122 under flexure urging it to return to its generally planar unflexed condition whereby the rods 128 at the longitudinal edges 122' of the sheet 122 are urged into and retained in engagement with the respective arcuate channel portion 138 of the mounting members 126'. With the sheets 122 thusly positioned and retained by the mounting members 126', the mating mounting members 126'' may readily be attached to their respective mounting members 126' to complete the channels 142 and to fully enclose the rods 128 along the longitudinal edges 122' of the sheets 22 for secure retainment thereof.

As will be readily seen, each sheet 122 in this embodiment is upwardly flexed and thereby arranged to shed and drain precipitation in the same manner as hereinbefore described regarding the upwardly flexed sheets 22 of the embodiment of FIGS. 1 and 5, the precipitation shed by the upwardly flexed sheets 22 draining either into the channel 142 of the mounting assemblies 126 or thereover into the gutters 156. As with the first-described embodiment of FIGS. 1 and 5, the supporting roof substructure of horizontal beams 18 preferably is provided with a slight pitch to enhance drainage along the gutters 156 and to permit drainage of moisture accumulating within the channels 142 to be exhausted from the lower-disposed open end thereof. Because of the described pitched drainage arrangement, the provision of the weep holes 148 are not necessary but may be desired in order to enhance drainage of moisture from within the channels 142.

The advantages of the mounting system of the present invention will be understood from the foregoing description of the two embodiments thereof. As previously indicated, the transparent polycarbonate plastic sheet material of the sheets 22,122 characteristically is of high thermo-expansivity and contractivity. By the particular present mounting arrangement, continuous-length sheets 22,122 of substantially any length of such plastic sheeting may be mounted to provide both secure retainment of the continuous-length sheets in their desired mounted disposition and to permit substantially free expansion and contraction thereof in relation to changes in ambient temperatures while also substantially preventing water leakage at the mounted sides of the sheeting. More specifically, the relative dimensionings of the rods 28,128 affixed to the edges of the sheets 22,122 and of the channels 42,142 of the mounting assemblies 26,126 permit a significant degree of relatively free movement of the rods 28,128 within the channels 42,142 while preventing disassembly of the rods 28,128 and the mounting assemblies 26,126 and thereby to prevent demounting of the longitudinal side edges 22',122'of the sheets 22,122 secured to the rods 28,128. In this manner, natural expansion and contraction of the sheets 22,122 is permitted to occur within a relatively wide range without affecting the mounted connection of the edges of the sheeting.

The flexure of the sheets 22,122 provides several advantages. First, the initial flexure of the sheets 22,122 causes the sheets to assume a generally arcuate mounted condition which effectively urges and constrains the sheets to expand and contract arcuately as well. Thus, in expansion of the sheets 22,122, the sheets expansively assume a more flexed arcuate condition about a relatively smaller radius whereas, in contrast, upon contraction of the sheets, the sheets contractively assume a less flexed arcuate condition about a larger radius. Thus, the expansion and contraction of the sheets 22,122 is caused to occur in a substantially consistant manner from one sheet to the next and from one instance of expansion or contraction to the next such that warping or other unsightly changes in the configuration of the sheets 22,122 does not occur and the appearance of the sheets in all expansive and contractive conditions thereof is not materially changed. More particularly in this regard, the circular configuration of the channel-defining walls of the mounting assemblies 26,126 aids in and enhances such expansive and contractive changes in the flexure of the sheets 22,122 in that such circular wall surfaces essentially act as cam surfaces for controlling and directing movements of the rods 28,128 within the channel 42,142 during expansion and contraction of the sheets 22,122. As illustrated in a somewhat exaggerated fashion in FIG. 5 (but also exemplary of all embodiments of the present invention), the disposition of the sheet 22 and its attached rods 28 relative to the channel 42 of the mounting member 26 in a relatively contracted condition of the sheet 22 is shown in full lines while, in contrast, the relative dispositions of these members in a more expanded condition of the sheet 22 is shown in broken lines. As will be understood, during expansion of the sheet 22, the compatible rounded periphery of the rods 28 and of the channel 42 permit the rod to readily slide along the wall surface defining the channel 42 to move between the two illustrated dispositions thereby permitting and aiding in the increased flexure of the sheet 22.

The flexure of the sheets 22,122 further enchances the aforedescribed drainage of rain and other precipitation. While the open connection between the mounting assemblies 26,126 and the rods 28,128, respectively, necessarily permits entry of water and other precipitation into the channels 42,142 of mounting assemblies 26,126 mounting upwardly-flexed sheets 22,122, the particular construction of the mounting assemblies 26,126 to orient their respective channels 42,142 to face upwardly when mounted for supporting upwardly-flexed sheets 22,122 and the provision of a pitch to the mounting assemblies 26,126 substantially and effectively prevents undesired leakage of water from the channels 42,142 from beneath upwardly-flexed sheets 22,122. In any event, the staggered arrangement of the upwardly and downwardly-flexed sheets 22 in the embodiment of FIGS. 1 and 5 and the provision of gutters 156 in the embodiment of FIGS. 2 and 6 prevent leakage of any water or other precipitation from above the sheets 22,122 to the sheltered area therebelow. Accordingly, the mounting connections between the sheets 22,122 and the respective mounting arrangements 24,124 effectively prevent water and precipitation leakage so as to effectively shelter the area therebelow.

Figure 7:
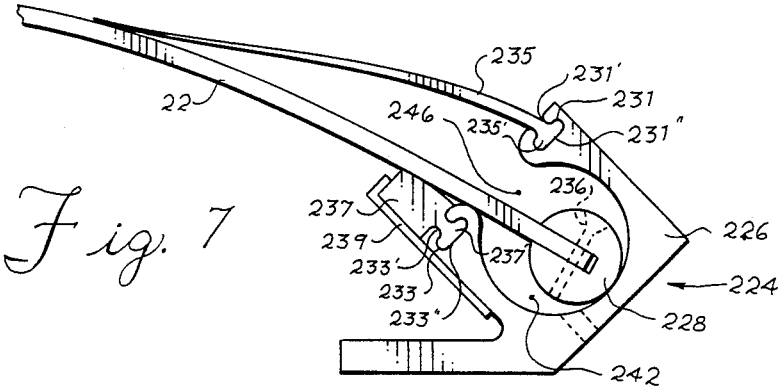
FIG. 7 is a partial end elevational view similar to FIG. 4 showing the use of sealing members in a mounting assembly of the present invention.

In certain applications, it may be desirable to provide a water-tight and air-tight seal between the sheets 22,122 and the mounting arrangements 24,124 respectively. For this purpose, another embodiment of the mounting arrangement 24 is provided and is illustrated in FIG. 7 generally at 224. The mounting arrangement 224 is substantially of the same construction as the mounting arrangement 24, including a mounting member 226 of substantially the same construction as the mounting member 26 and employing cylindrical rods 228 substantially the same as the rods 28. According to this embodiment, the main body 238 of the mounting member 226 has longitudinal grooves 231,233 respectively extending the length of the mounting member 26 on opposite sides of the outwardly opening area 246 of the channel 242. Each groove 231,233 has a restricted entrance opening 231',233' and an enlarged interior area 231",233". A sheet-like gasket member 235 of rubber or another resilient water-impervious sealing material is provided and includes an attachment portion 235' configued compatibly with the groove 231 for resilient snap-fitting thereinto to extend therefrom into sealing surface contact with the adjacent surface of the sheet 22. A block-like gasket 237 of rubber or another compressable sealing material is also provided and has an attachment portion 237' configured compatibly with the groove 233 to be resiliently snap-fitted therein to extend therefrom into sealing surface contact with the adjacent surface of the sheet 22. As will be appreciated, the block-like gasket member 237 ordinarily is arranged in the groove 231 or 233 disposed adjacent the underside of the sheet 22 depending upon the disposition of the mounting member 226 for supporting an upwardly-flexed or a downwardly-flexed sheet 22, such that the sheet 22 will rest upon the block-like gasket 233 under the weight of the sheet to effect the sealing contact therebetween. A supporting plate 239 is affixed to the surface 238' of the main body 238 of the mounting member 226 and extends therefrom to support the block-like gasket member 237. As will be appreciated by those skilled in the art, the mounting members 126',126" of the mounting assembly 126 of FIGS. 2 and 6 may be constructed with modified arcuate channel portion 138,147 adapted to similarly receive sealing gasket members to provide watertight seals between the sheet 122 and the mounting assembly 126.

Those skilled in the art will readily appreciate that the mounting system of the present invention may be adapted for supporting continuous length plastic sheeting in a wide variety of embodiments other than the rain shelters 10,12. For instance, there is illustrated in FIGS. 8–10 the embodiment of the mounting system of the present invention in an overhead skylight assembly, indicated generally at 310, in the roof or other structural surface 315 of a building structure or the like. In the skylight assembly 310, a single plastic sheet 322 is employed, being mounted at its longitudinal side edges 322' by mounting arrangements 324 according to the present invention and being mounted at its end edges 322" in conventional manner by aluminum mounting plates 325. As best seen in FIGS. 9 and 10, the building structure includes interior walls 317 which extend upwardly beyond the roof 315 a short distance to define between the walls 317 the skylight opening 311. In conventional manner, blocking 319 is affixed in abutment with the roof 315 and the walls 317 perimetrically about the upwardly extending portions of the walls 317 to form a curb about the skylight opening 311 and stepped flashing 321 is affixed to the upper and outer surfaces of the blocking 319 and to the upper surfaces of the roof 317 adjacent thereto. Two mounting assemblies 326 of identical construction to the mounting assembly 126 of the above-described embodiment of FIGS. 2, 4 and 6 are affixed respectively to the flashing 321 at the upper surfaces of the blocking 319 along the lengthwise sides of the skylight opening 311 in the aforedescribed opposed facing relation. As in the aforedescribed embodiment of Figues 2, 4 and 6, the mounting assemblies 126 support the lengthwise side edges of the sheet 322, the installation and assembly thereof being effected in the same manner as previously described. Each plate 325 is of a substantially arcuate construction corresponding to the desired arcuate flexure of the sheet 322 and includes a mounting flange 327 extending transversely of the arcuate edge of the plate 325 and includes two flanges 329 extending from the outer arcuate edge of the plate 325 in spaced relation to one another to define therebetween a receiving channel 331. The two plates 325 are affixed by their respective mounting flanges 327 to the flashing 321 on the upper surface of the blocking 319 along the respective widthwise sides of the skylight opening with the respective channels 331 of the plates 325 in opposed facing relation and receiving therein the end edges 322" of the sheet 322. Preferably, the mounting assemblies 326 are provided with sealing gaskets (not shown) in sealing contact with the upper and lower surfaces of the sheet 322 and similarly the aluminum plates 325 have sealing gaskets 333 along the inward surfaces of their flanges 329 in sealing engagement with the end edges 322" of the sheet 322.

Several other embodiments of the mounting system of the present invention are also contemplated. For instance, the novel appearance provided by a mounted arrangement of plural continuous length sheets according to the present invention may also be employed for ornamental purposes. Thus, it is contemplated that a side-by-side arrangement of plural continuous length sheets mounted according to the present invention may be employed as an architectural glazing for covering the entirety of the upright exterior wall surfaces of a multi-story office building. Similarly, a side-by-side mounted arrangement of sheets according to the present invention may be employed as a partition wall. A mounting assembly of one or more continuous length sheets may also be employed as an overhead canopy for a walkway or the like. Additionally, the present invention will be understood to have applicability in the mounting of continuous length sheeting of materials other than transparent plastic material, e.g. stainless steel or aluminum sheeting. Numerous other embodiments, adaptations, variations and modifications of the mounting system of the present invention will occur to those persons skilled in the art. The foregoing disclosure of the present invention has been made in regard to certain preferred embodiments thereof solely by way of example to provide an enabling disclosure of the present invention to persons skilled in the art. The present invention is not limited to the particular embodiments thereof herein illustrated and described but instead includes within its scope any and all other embodiments, adaptations, variations, modifications and equivalent arrangements that would be apparent from or reasonably suggested by the foregoing disclosure to those persons skilled in the art, the present invention being limited only by the claims appended hereto and equivalents thereof.

I claim:

1. Apparatus for mounting an edge of a continuous sheet of thermo-expansive and contractive material to a supporting surface comprising means adapted for affixation at said edge of said sheet for forming a thickness enlargement thereat, and mounting means adapted for affixation to said supporting surface and having channel means for receiving and retaining therein said enlargement, said channel means defining an enlarged interior receiving area profiled compatibly with and sufficiently larger than said enlargement to leave space in said receiving area unoccupied by said enlargement for permitting relatively free shifting movement of said enlargement within said receiving area in response to thermal expansion and contraction of said sheet and said channel means further defining a restricted outward opening smaller than said enlargement to retain said enlargement in said receiving area but sufficiently larger than the thickness of the adjacent unenlarged portion of said sheet for extension of said sheet outwardly through said restricted opening and to leave space in said restricted opening unoccupied by said adjacent unenlarged portion of said sheet for permitting relatively free shifting movement of said adjacent portion of said sheet within said restricted opening in response to thermal expansion and contraction of said sheet.

2. Apparatus according to claim 1 and characterized further in that said enlargement is substantially smoothly rounded and said receiving area is compatibly substantially smoothly rounded such that upon engagement therebetween during said shifting movement the rounded surface of said receiving area provides a cam surface for relatively free sliding movement of said enlargement thereabout.

3. Apparatus according to claim 2 and characterized further in that said enlargement-forming means comprises longitudinal rod means of substantially circular transverse cross-section having a longitudinal channel therein for receiving said edge of said sheet to form said enlargement as a circular bead and said channel means is of at least a corresponding longitudinal extent and its said receiving area is of substantially circular transverse cross-section.

4. Apparatus according to claim 3 and characterized further in that said edge of said sheet is substantially linear, in that said enlargement-forming means includes a plurality of said rod means for spaced affixation along said edge, each said rod means being substantially cylindrical with its said channel being substantially axial, and in that said channel means is at least substantially the same length as said edge.

5. Apparatus according to claim 2 and characterized further in that said restricted opening is generally rounded for non-abrasive contact with said adjacent sheet portion during said shifting movement.

6. Apparatus according to claim 1 and characterized further by water-impervious flexible sealing members adapted to be affixed to said channel means on each side of said restricted opening respectively to extend therefrom into sealing contact with the respectively adjacent sides of said sheet.

7. Apparatus according to claim 1 and characterized further in that said mounting means is adapted for affixation to said supporting surface with said channel means extending generally horizontally and with said restricted opening facing generally upwardly for drainage of water into said channel means.

8. Apparatus according to claim 7 and characterized further in that said channel means includes a weep hole extending therethrough outwardly from said receiving area for drainage of water entering said channel means.

9. Apparatus according to claim 1 and characterized further in that said channel means is open at at least one of its ends for slidable insertion of said enlargement into said receiving area and of the adjacent unenlarged portion of said sheet into said restricted opening.

10. Apparatus according to claim 1 and characterized further in that said channel means includes selectively assemblable and disassemblable mating channel members adapted in disassembly for receiving said enlargement and said adjacent portion of said sheet and adapted in assembly for defining said restricted opening and said receiving area for retaining said enlargement.

11. Apparatus according to claim 1 and characterized further in that said sheet material is a generally transparent plastic polycarbonate.

12. A sheet mounting assembly in a building structure or the like comprising (a) a continuous sheet of thermo-expansive and contractive material, (b) means forming respective thickness enlargements along two opposed edges of said sheet, and (c) two elongated mounting means affixed in spaced relation to said building structure and having respective spaced generally facing channel means receiving and retaining therein said enlargements respectively, each said channel means defining an enlarged interior receiving area in which the respectively associated enlargement is received and defining a restricted outward opening through which extends the adjacent unenlarged portion of said sheet, each said receiving area being profiled compatibly with and sufficiently larger than its said associated enlargement to leave space in said receiving area unoccupied by said associated enlargement to permit relatively free shifting movement of said associated enlargement within said receiving area in response to thermal expansion and contraction of said sheet and each said restricted opening being smaller than its said associated enlargement to retain said associated enlargement in said receiving area but sufficiently larger than the unenlarged thickness of said adjacent portion of said sheet to leave space in said restricted opening unoccupied by said adjacent sheet portion for permitting relatively free shifting movement of said adjacent sheet portion within said restricted opening in response to thermal expansion and contraction of said sheet.

13. A sheet mounting assembly according to claim 12 and characterized further in that each said enlargement is substantially smoothly rounded and each said receiving area is compatibly substantially smoothly rounded such that, upon engagement between the associated ones thereof during said shifting movement, the rounded surface of each said receiving area provides a cam surface for relatively free sliding movement of its associated enlargement thereabout.

14. A sheet mounting assembly according to claim 13 and characterized further in that said two edges are generally parallel longitudinal side edges of said sheet, in that said enlargement-forming means comprises a plurality of cylindrical rod means having respective axial channels therein spaced along said edges and receiving said edges in said axial channels to form said enlargements as circular beads, and in that each said channel means is at least substantially the same length as the associated edge of said sheet and said receiving areas are of substantially circular transverse cross-section.

15. A sheet mounting assembly according to claim 14 and characterized further in that said restricted openings are generally rounded for non-abrasive contact with said adjacent sheet portions during said shifting movement.

16. A sheet mounting assembly according to claim 12 and characterized further by water-impervious flexible sealing members affixed to each said channel means on each side of its said restricted opening respectively extending therefrom into sealing contact with the respectively adjacent side of said sheet.

17. A sheet mounting assembly according to claim 12 and characterized further in that said channel means of said mounting means are spaced apart a distance smaller than the dimension of said sheet between said opposed edges for mounting of said sheet in a flexed condition such that expansion and contraction thereof effects increase and decrease, respectively, in its flexed condition.

18. A sheet mounting assembly according to claim 17 and characterized further in that said restricted openings of said channel means face in the direction of flexure of said sheet.

19. A sheet mounting assembly according to claim 18 and characterized further in that said channel means extend generally horizontally with their said restricted openings facing generally upwardly and said sheet is flexed upwardly for drainage of water into said channel means.

20. A sheet mounting assembly according to claim 19 and characterized further in that said sheet material is a generally transparent plastic polycarbonate for forming a skylight.

21. A sheet mounting assembly according to claim 19 and characterized further in that each said channel means includes a weep hole extending therethough outwardly from said receiving area for drainage of water entering said channel means.

22. A structural surface in a building structure or the like comprising (a) a plurality of continuous sheets of thermo-expansive and contractive material arranged in generally side-by-side relation forming a generally continuous transparent surface, and (b) for each said sheet, (i) means forming a respective thickness enlargement along two opposed edges thereof, and (ii) two elongated mounting means affixed in spaced relation to said building structure and having respective spaced, generally facing channel means receiving and retaining therein said enlargements respectively, each said channel means defining an enlarged interior receiving area in which the respectively associated enlargement is received and defining a restricted outward opening through which extends the adjacent unenlarged portion of said sheet, each said receiving area being profiled compatibly with and sufficiently larger than its said associated enlargement to leave space in said receiving area unoccupied by said associated enlargement to permit relatively free shifting movement of said associated enlargement within said receiving area in response to thermal expansion and contraction of said sheet and each said restricted opening being smaller than its said associated enlargement to retain said associated enlargement in said receiving area but sufficiently larger than the unenlarged thickness of said adjacent portion of said sheet to leave space in said restricted opening unoccupied by said adjacent sheet portion for permitting relatively free shifting movement of said adjacent sheet portion within said restricted opening in response to thermal expansion and contraction of said sheet.

23. A structural surface according to claim 22 and characterized further in that said two opposed edges of each said sheet are generally parallel longitudinal side edges thereof, and in that said plurality of said sheets are arranged with all said edges generally parallel with one another.

24. A structural surface according to claim 23 and characterized further in that the respective channel means of each said two mounting means are spaced apart a distance smaller than the dimension of their associated sheet between its said opposed edges for mounting of said sheet in a flexed condition such that expansion and contraction thereof effects increase and decrease, respectively, in its flexed condition.

25. A structural surface according to claim 24 and characterized further in that all of said plurality of sheets are flexed outwardly of said building structure.

26. A structural surface according to claim 25 and characterized further in that all said channel means extend generally horizontally and all said sheets are flexed upwardly and characterized further by a respective longitudinal gutter extending between and below each adjacently-disposed non-associated pair of mounting means for substantially the full length thereof.

27. A structural surface according to claim 26 and characterized further in that all said restricted openings face generally upwardly in the direction of flexure of said sheets for drainage of water into said channel means, each said channel means including a weep hole extending therethrough outwardly from its said receiving area and opening adjacent its associated gutter for drainage of said water thereinto.

28. A structural surface according to claim 24 and characterized further in that alternating sheets of said plurality of sheets are flexed outwardly of said building structure and intermediate sheets of said plurality of sheets are flexed inwardly of said building structure.

29. A structural surface according to claim 28 and characterized further in that all said channel means extend generally horizontally, in that said alternating sheets are flexed upwardly and said intermediate sheets are flexed downwardly, and in that said mounting means of said upwardly-flexed and downwardly-flexed sheets are respectively disposed such that a downwardly-flexed sheet extends between and below each adjacently-disposed pair of upwardly-flexed sheets.

30. A structural surface according to claim 29 and characterized further in that said restricted openings of said channel means of said upwardly-flexed sheets face generally upwardly in the direction of flexure of their associated sheets for drainage of water into their channel means, in that each said channel means of said upwardly-flexed sheets includes a weep hole extending therethrough from its said receiving area and opening adjacent the adjacently-disposed downwardly-flexed sheet for drainage of said water thereonto, and in that each said downwardly-flexed sheet is inclined slightly downwardly along its length toward one end thereof for drainage of said water thereto and thereover.

31. A structural surface according to claim 23 and characterized further in that each said enlargement is substantially smoothly rounded and each said receiving area is compatibly substantially smoothly rounded such that upon engagement between associated ones thereof during said shifting movement the rounded surface of each said receiving area provides a cam surface for relatively free sliding movement of its associated enlargement thereabout and characterized further in that said restricted openings are generally rounded for non-abrasive contact with said adjacent sheet portions during said shifting movement.

32. A structural surface according to claim 31 and characterized further in that each said enlargement-forming means comprises a plurality of cylindrical rod means having respective axial channels therein spaced along said edges of its associated sheet and receiving said edges in said axial channels to form said enlargements as circular beads, and in that each said channel means is at least substantially the same length as the associated edges of its associated sheet and each said receiving area is of substantially circular transverse cross-section.

33. A structural surface according to claim 22 and characterized further in that said sheet material is a generally transparent plastic polycarbonate.

* * * * *